US005900820A

United States Patent [19]

Yankielun

[11] Patent Number: 5,900,820

[45] Date of Patent: May 4, 1999

[54] SYSTEM AND METHOD FOR DETECTION OF FRAZIL ICE ON UNDERWATER GRATING

[75] Inventor: Norbert E. Yankielun, Lebanon, N.H.

[73] Assignee: The United States of America as represented by the Secretary of the Army, Washington, D.C.

[21] Appl. No.: 08/871,624

[22] Filed: Jun. 9, 1997

[51] Int. Cl.[6] ..... G08B 19/02

[52] U.S. Cl. ..... 340/580; 73/170.29; 324/663

[58] Field of Search ..... 340/580, 583, 340/852; 73/170.26, 170.29; 324/663, 664, 667, 669, 670; 367/141

[56] References Cited

U.S. PATENT DOCUMENTS

| | | | |
|---|---|---|---|
| 3,600,674 | 8/1971 | Brea et al. | 324/557 |
| 4,054,255 | 10/1977 | Magenheim | 244/134 F |
| 4,072,941 | 2/1978 | Hamid et al. | 342/22 |
| 4,270,049 | 5/1981 | Tanaka et al. | 340/605 X |
| 4,287,472 | 9/1981 | Pan et al. | 340/580 X |
| 4,819,480 | 4/1989 | Sabin | 73/170.26 |
| 5,062,120 | 10/1991 | Daly et al. | 374/143 |
| 5,134,380 | 7/1992 | Jonas | 324/674 |
| 5,243,294 | 9/1993 | Burnett | 324/535 |
| 5,381,694 | 1/1995 | Glynn et al. | 73/627 |
| 5,446,448 | 8/1995 | Zufelt et al. | 340/580 |
| 5,467,944 | 11/1995 | Luukkala | 244/134 F |
| 5,521,584 | 5/1996 | Ortolano et al. | 340/581 |

*Primary Examiner*—Thomas J. Mullen, Jr.
*Attorney, Agent, or Firm*—Luther A. Marsh

[57] ABSTRACT

A system for detecting accretion of frazil ice on underwater gratings includes a housing for disposition beneath a water surface and spaced from but proximate an underwater intake grating. A pair of parallel electrically conductive bars are mounted side-by-side in the housing and extend therefrom. The bars are in communication with an electromagnetic wave generator in the housing. A coaxial transmission line is connected at a first end to the housing and in communication with the pair of bars for extension from the housing upwardly above the water surface. A monitoring station is disposed above the water surface for receiving signals from the bars, the monitoring station having a second end of the transmission line fixed thereto. The wave generator propagates electromagnetic waves to the bars for further travel to distal ends of the bars, and back to the housing and thence to the monitoring station. The monitoring station is adapted to compute wave round trip travel time in the bars and to compute changes in the round trip travel time, from which is determined absence, presence, and build-up of frazil ice on the bars, thereby providing an indication of same on the grating.

16 Claims, 4 Drawing Sheets

SYSTEM AND METHOD FOR DETECTION OF FRAZIL ICE ON UNDERWATER GRATING

BACKGROUND OF THE INVENTION

1. Field of the Invention

This invention relates to the icing up of underwater intake gratings in cold water, and is directed more particularly to a reliable and economical system and method for monitoring ice build-up from a convenient remote location.

2. Description of the Prior Art

Industrial, commercial and municipal facilities located in regions subject to seasonal freezing, and which are required to draw quantities of water from rivers during the freezing seasons, are subject to the deleterious effects of buildup of frazil ice on gratings protecting water intakes from ingestion of foreign objects and aquatic life. The effects can include, depending on the nature of the facility in question, lower operating efficiencies, loss of cooling water, damage to pumps and other components, and loss of revenues because of down time.

"Frazil ice" is formed when turbulent water is cooled. Once the water is supercooled a few hundredths of a degree, minute ice crystals form in the water and conglomerate, resulting in flocks of frazil ice. Frazil ice forms mainly in rivers, but has been experienced in lakes, cooling ponds, and even in the ocean. Many water intakes for power generation plants and other industrial and commercial processing plants have waterway approaches that are subject to turbulent flow, a prime condition for the formation of frazil ice. As long as the water temperature is at, or below, freezing, it is possible for frazil ice to form. Once formed, frazil ice adheres to, and continues to accrete on, virtually any natural or man-made object in the water, including rocks, wood, and metal structures, and including protective gratings over water intakes. Water intakes have been known to completely occlude in a matter of a few hours.

Currently, the only detection and alarm systems in implementation consist of complex mechanical systems with moving components, having low reliability and requiring significant maintenance. There is thus a need for a simple, economical, reliable, and low maintenance system for detection and monitoring of growth of frazil ice on water intake gratings.

SUMMARY OF THE INVENTION

Accordingly, an object of the invention is to provide a system for detecting and monitoring accretion of frazil ice on underwater gratings, which system is devoid of moving mechanical parts, is reliable, economical, and requires little maintenance.

A further object of the invention is to provide a method for detecting and monitoring accretion of frazil ice on underwater gratings, which method is simple and reliable in operation.

With the above and other objects in view, as will hereinafter appear, a feature of the present invention is the provision of a system for detection of frazil ice on underwater gratings, the system comprising a housing for disposition beneath a water surface and spaced from but proximate an underwater intake grating, an electromagnetic wave generating means disposed in the housing, and a pair of parallel electrically conductive bodies mounted side-by-side in the housing and extending therefrom, the bodies being in communication with the wave generating means. A coaxial transmission line is connected proximate a first end thereof to the pair of bodies for extension from the bodies, and the housing, upwardly above the water surface. A monitoring station is disposed above the water surface for receiving signals from the bodies, the monitoring station having a second end of the transmission line fixed thereto. The wave generating means is adapted to propagate electromagnetic waves to the bodies for further travel to distal ends of the bodies and back to the housing and thence to the monitoring station. The monitoring station is adapted to compute round trip travel time of the waves in the bodies, and to compute changes in the round trip travel time, from which is determined absence, presence, and build-up of frazil ice on the bodies, whereby to provide an indication of same on the grating.

In accordance with a further feature of the invention, there is provided a method for detecting frazil ice on an underwater grating, the method comprising the steps of providing a housing having an electromagnetic wave generating means therein, and a pair of electrically conductive bodies mounted side-by-side therein and extending therefrom, the bodies being in communication with the wave generating means, positioning the housing beneath a water surface and spaced from but proximate an underwater intake grating, and providing a monitoring station connected to the housing and the bodies by coaxial cable, and positioning the monitoring station above the water surface. The wave generating means is actuated to propagate electromagnetic waves to the bodies for further travel to distal ends of the bodies and back to the housing and thence to the monitoring station, the monitoring station being provided with means for computing round trip travel time of the waves in the bodies, and to compute changes in the round trip travel time, from which is determined absence, presence, and build-up of frazil ice on the bodies, to provide an indication of same on the grating.

The above and other features of the invention, including various novel details of construction and combinations of parts, will now be more particularly described with reference to the accompanying drawings and pointed out in the claims. It will be understood that the particular devices and methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
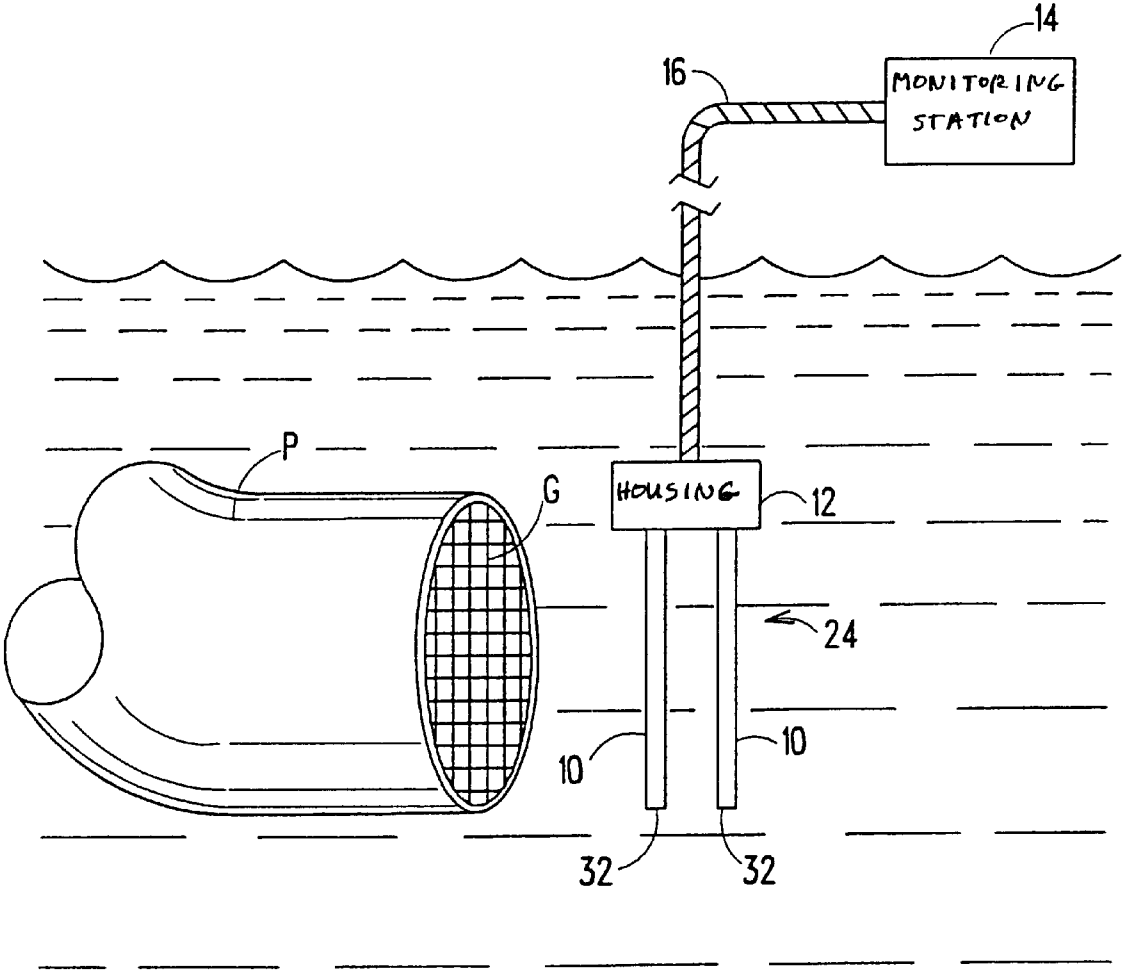
FIG. 1 is a diagrammatic view of one form of system illustrative of an embodiment of the invention.

Referring to FIG. 1, it will be seen that the system includes a pair of parallel metal bodies, such as bars 10, fixed in a housing 12 and extending therefrom. The housing 12 is connected to a monitoring station 14 by a transmission line 16.

Figure 2:
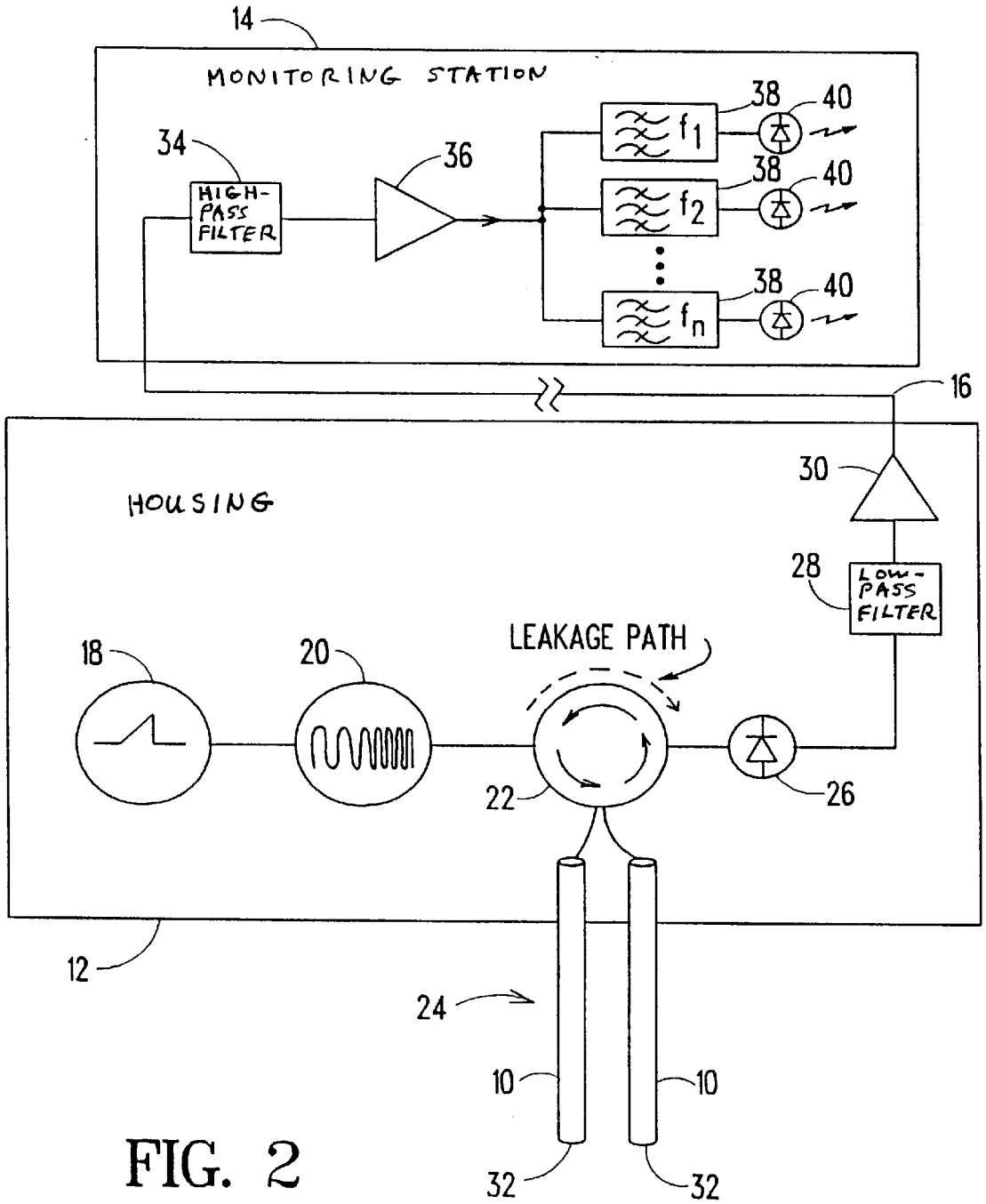
FIG. 2 is a diagrammatic view of components of the system of FIG. 1.

Referring to FIG. 2, it will be seen that the housing 12 houses a linear ramp generator 18 in communication with a voltage controlled oscillator (VCO) 20 which, in turn, is in communication with a circulator 22. The circulator 22 is connected to the bars 10 which, together, comprise a sensor 24. The circulator 22 is further connected to a mixer diode 26, which is wired to a radio frequency low-pass filter 28. The latter :Ls connected to an audio amplifier 30 which, in turn, is connected to the transmission line 16. The housing 12 is water-proof and the components therein preferably are encapsulated in the housing 12.

The linear ramp generator 18 drives the VCO 20 to produce a signal of steady amplitude and of a frequency increasing linearly with time. The signal propagates down through the sensor 24 and is reflected from the distal ends 32 thereof, returning to the circulator 22. The velocity of the signal propagating along the sensor 24 depends upon the value of the dielectric constant of the media surrounding the sensor bars 10.

In freshwater the dielectric constant of the media surrounding the sensor is 80; in solid freshwater ice it is 3.12. Frazil ice immersed in liquid water has a dielectric constant which is a mixture of those of water and ice. This mixture may not always have a constant value in all formation and accretion situations, but in all cases the bulk dielectric (bulk index of. refraction) of the mixture is less than that of liquid water alone. Therefore, as frazil ice accretes on the metal rod sensor 24, the bulk dielectric constant of the water/ice in immediate proximity to the sensor 24 decreases and the propagation velocity of the sensor 24 increases, proportionally decreasing the sensor round trip travel time. It is the decrease in round trip travel time that is measurable, and is used to indicate the absence, presence or buildup of frazil ice on the sensor, which is substantially equal to the same conditions on nearby gratings, or other submerged structures of interest.

Thus, as ice accretes on the submerged sensor 24, the transmitted electromagnetic signal propagates at higher velocities. The change in time required for an electromagnetic signal to propagate down and back along the sensor 24 can be electronically measured and thereby used to initiate an alarm indicating the presence of frazil ice.

Figure 3:
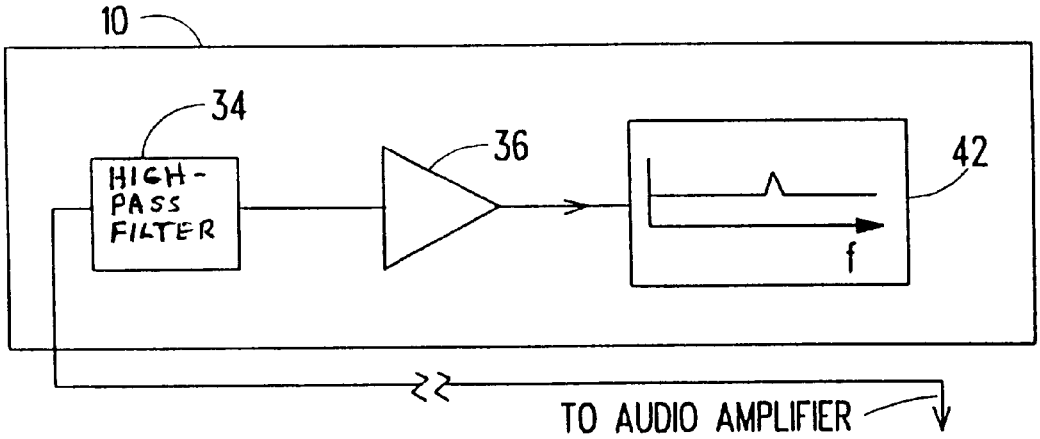
FIG. 3 is a diagrammatic view of alternative components of the system of FIG. 2.

In preparing for operation, the parallel metal bar sensor 24 and the housing 12 are immersed in water in close proximity, but not in electrical contact, with a grating G protecting a water input pipe P (FIG. 1). An initial reference reading is made of the frequency spectrum of the audio tone generated by the housing electronics, indicating the frazil ice free state. This data is stored in computer memory or other electronic means. Subsequently, the frequency spectrum of the sensor output is periodically, automatically compared with the original reference value. As frazil ice builds up on the parallel metal bar sensor 24, a component of the frequency spectrum of the sensor output becomes lower. A simple bank of audio frequency filters 38 (FIG. 2) or a spectrum analyzer 42 (FIG. 3) can be used to monitor the output frequency of the sensor and trigger an alarm when a threshold difference in frequency is reached, signaling that some maintenance action should be taken to free the intake grating G of frazil ice.

In operation, a steady amplitude signal whose frequency increases linearly with time is produced by the VCO 20. The signal is a frequency modulated continuous wave signal driven by the linear ramp generator 18. The signal propagates down the bars 10 and is reflected from the distal ends 32, returning to the source, delayed by the round-trip propagation time $2t_p$. It is mixed with a reference signal taken directly from the VCO output that is fed to the mixer diode 26 by means of a leakage path through the circulator 22 (FIG. 2). The mixing process produces sum, Σf, and difference frequency, Δf, spectra. Low pass filtering is applied by the low pass filter 28 to retain only Δf. Within Δf, one component $F_r$, is proportional to the distance to the end of the sensor, D, and can be determined using spectral analysis techniques. For a constant velocity medium of refractive index n,D is found from $$D(m) = \frac{(F_r)(t_{swp})c}{(2\Delta F)(n)}$$

where $F_r$=difference frequency due to radar reflection (Hz)

$t_{swp}$=frequency modulation—continuous wave (FM-CW) sweep time (s)

c=velocity of light in a vacuum (m/s)

ΔF=FM-CW swept bandwidth (Hz)

The difference frequency spectra usually lie in the audio range. The spectra has a similar appearance to a time domain reflectometry (TDR) scan and can be calibrated as such with distance, D, related to travel time, t, by $$t = \frac{Dn}{c}$$

Referring again to FIG. 2, the linear ramp generator 18 or, alternatively, a sinusoid generator (not shown) is used to periodically drive the rf voltage controlled oscillator (VCO) 20 with sufficient swept bandwidth (typically, 100 to 1000 MHz of bandwidth). The output of the VCO 20 is coupled to the parallel bars 10 through the circulator 22 (or "T", "magic T", power splitter, or similar device) that permits signal flow from the VCO 20 to the bars 10. The swept signal propagates down the bars 10, reaches the distal ends 32 and is reflected back to the circulator 22. At the circulator 22, the reflected signal is routed to the mixer diode 26. There it is mixed with the reference signal that has propagated across the leakage path through the circulator and the short path between the VCO 20 arid the mixer 26. The resulting output of the mixer 26 consists of a high frequency signal, Σf, and a low frequency, audio-range difference signal, Δf. The rf low-pass filter 28 passes Δf and attenuates Σf to a level making it inconsequential. The audio amplifier 30 increases the level of the Δf signal appropriately for transmission via the line 16 from the submerged sensor 24 and electronics package of housing 12 (FIG. 2) to the surface and to the station 14 where it can be monitored. Alternatively, surface transmission of the signal can be performed by radio or other form of telemetry. The signal is filtered through an audio high pass filter 34 to remove D.C. and low-frequency audio components, and is again amplified, as by an amplifier 36, to a level necessary for subsequent processing. Filter 34 may be located in the housing 12 as part of the electronics package therein. The audio signal is then passed through the bank of tuned audio band-pass filters 38, each interfaced to a light-emitting diode (LED) 40. As the audio difference frequency, Δf, changes, depending on the state of frazil accretion on the sensor, a different LED 40 lights, visually indicating the state of the sensor. Alternatively to the audio band-pass filter bank 38, an audio spectrum analyzer 42 (FIG. 3) or data acquisition-equipped computer (not shown) can provide a visual indication of the spectra, and through an appropriate algorithm, provide alarm indication.

Figure 4:
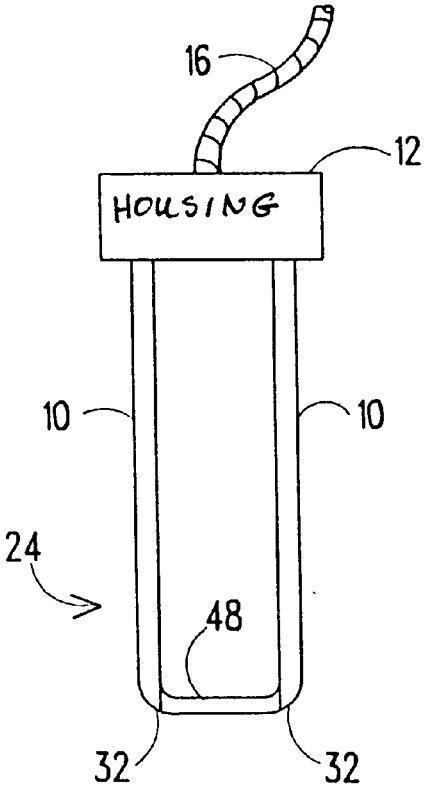
FIG. 4 is a front elevational view of an alternative embodiment of a portion of the system of FIGS. 1–3.
Figure 5:
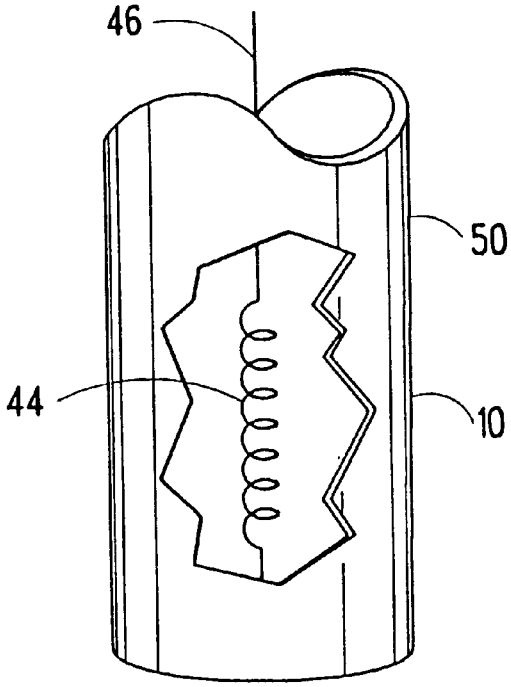
FIG. 5 is an elevational, broken away, view of an alternative embodiment of a portion of the system of FIGS. 1–3.

The sensor 24 can be cleared of frazil ice buildup in several ways. The sensor can be mechanically cleared by maintenance personnel while clearing the intake grating. There are also at least two methods by which the sensor can be electrically cleared. If the sensor is fabricated using for the two bodies 10 two parallel metallic tubes 50 (one shown in FIG. 5), instead of solid rods, electrical heating elements 44 can be placed internally of the tubes 50 and activated through a power line 46 as appropriate. Additionally, based on transmission line theory, the distal ends 32 of the sensor bars 10 may be open circuited (FIG. 1) or permanently shorted together by a third bar 48 (FIG. 4), without affecting pulse propagation. In use of a distally shorted sensor (FIG. 4), a high current may be applied to the transmission line to impart heat thereto and clear any frazil ice buildup.

There may be circumstances in which foreign objects (e.g., rag, plastic bag, log, etc.) come into contact with the frazil ice sensor and produce a false indication of ice accretion. To decrease the probability of a false indication, a temperature sensor (not shown) may be co-located with the frazil ice sensor 24. The output of the temperature sensor can be used in conjunction with the monitoring station data to verify the presence of frazil ice. That is, if the temperature sensor detects ambient water temperature at the submerged frazil probe inconsistent with supercooled water, then it can be surmised that frazil ice has not formed.

As a further confirmation of the presence of frazil ice growth vs. false reading from some foreign material impinged against the frazil ice sensor, the sensor can be briefly heated in an attempt to melt any frazil accretion. If a change in signal transmission velocity, before and after heating, is noticed, then it can be concluded that the sensor was accreted with frazil ice. If the signature remains the same prior to, and after, heating, then there is a high probability that the sensor is fouled by a foreign object and requires maintenance.

There is thus provided a system providing remote and continuous monitoring, no moving mechanical parts, low maintenance, and simple installation and operation. Further, in due course, only the sensor 24 of the system will require periodic replacement and the sensor is a low-cost item.

Figure 6:
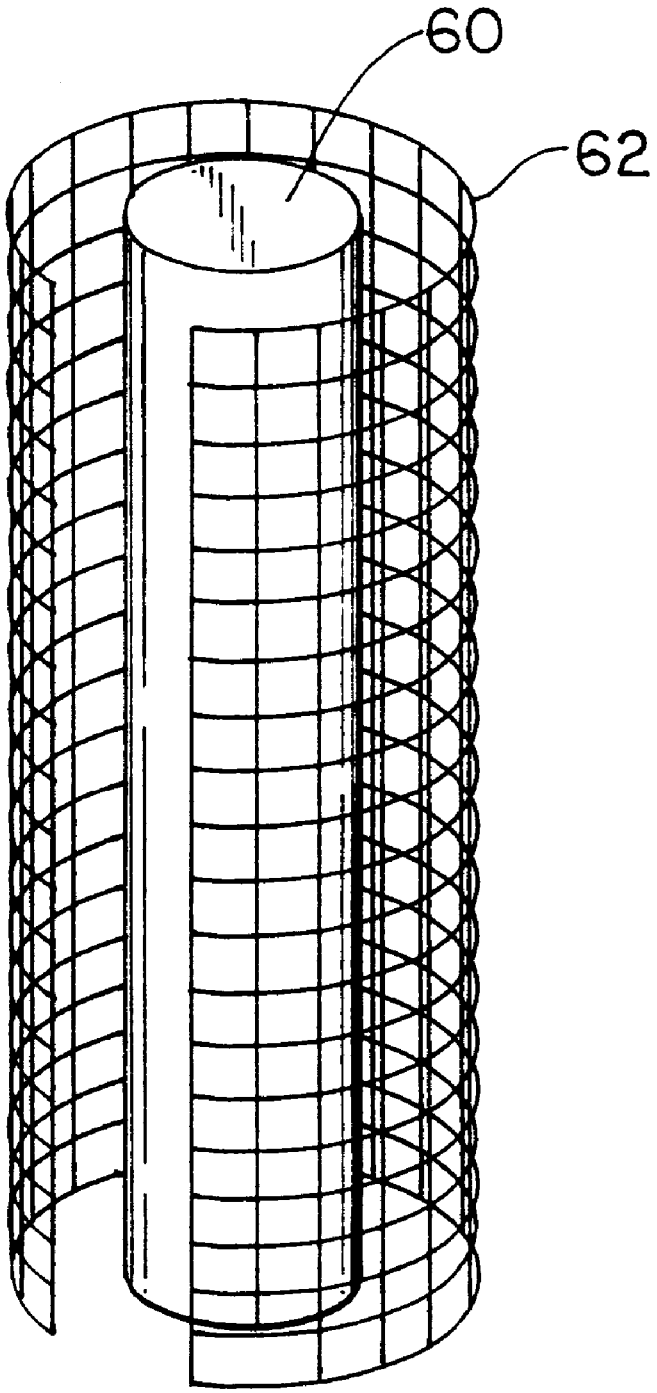
FIG. 6 is a perspective view of another alternative embodiment of a portion of the system of FIGS. 1–3.

It is to be understood that the present invention is by no means limited to the particular construction herein disclosed and/or shown in the drawings, but also comprises any modifications or equivalents within the scope of the claims. For example, while the sensor 24 may comprise parallel bars, or tubes, as described above, other arrangements of electrically conductive bodies will be apparent to those skilled in the art. One alternative arrangement is shown in FIG. 6, wherein a central rod, or tube, 60 is disposed concentrically within an interrupted mesh sleeve 62. As water flows through the mesh, frazil ice accretes between the mesh 62 and the rod, or tube, 60.

What is claimed is:

1. A system for detecting accretion of frazil ice on underwater gratings, said system comprising:

a housing for disposition beneath a water surface and spaced from but proximate an underwater intake grating;

an electromagnetic wave generating means disposed in said housing;

a pair of parallel electrically conductive bodies mounted side-by-side in said housing and extending therefrom, said bodies being in communication with said wave generating means;

a coaxial transmission line connected proximate a first end thereof to said housing and in communication with said pair of bodies for extension from said housing, upwardly above the water surface; and a monitoring station for disposal above the water surface and for receiving signals from said bodies, said monitoring station having a second end of said transmission line fixed thereto;

said wave generating means being adapted to propagate electromagnetic waves to said bodies for further travel to distal ends of said bodies and back to said housing and thence to said monitoring station;

said monitoring station being adapted to compute round trip travel time of said waves in said bodies, and to compute changes in said round trip travel time, from which is determined absence, presence, and build-up of frazil ice on said bodies;

whereby to provide an indication of same on said grating.

2. The system in accordance with claim 1 wherein said bodies are coextensive.

3. The system in accordance with claim 2 wherein said bodies are of metal.

4. The system in accordance with claim 3 wherein said bodies are solid metal bars.

5. The system in accordance with claim 4 further comprising a third metal bar interconnecting said parallel bars at distal ends of said parallel bars.

6. The system in accordance with claim 3 wherein said bodies are tubular metal members.

7. The system in accordance with claim 6 wherein a heating coil is disposed in each of said tubular metal members.

8. The system in accordance with claim 2 wherein one of said bodies is a metal rod and a second of said bodies is a generally cylindrically-shaped metal mesh sleeve disposed generally concentrically around said rod and spaced therefrom, said sleeve having a gap therein in a wall thereof extending substantially throughout a length of said sleeve.

9. A method for detecting accretion of frazil ice on an underwater grating, said method comprising the steps of:

providing a housing having an electromagnetic wave generating means therein, and a pair of electrically conductive bodies mounted side-by-side therein and extending therefrom, the bodies being in communication with the wave generating means;

positioning the housing beneath a water surface and spaced from but proximate an underwater intake grating;

providing a monitoring station connected to the housing and the bodies by coaxial cable, and positioning the monitoring station above the water surface;

actuating the wave generating means to propagate electromagnetic waves to the bodies for further travel to distal ends of the bodies and back to the housing and thence to the monitoring station, the monitoring station being provided with means for computing round trip travel time of the waves in the bodies, and to compute changes in the round trip travel time, from which is determined absence, presence, and build-up of frazil ice on the bodies, to provide an indication of same on the grating.

10. The method in accordance with claim 9 wherein said bodies are of metal.

11. The method in accordance with claim 10 wherein said bodies are solid bars.

12. The method in accordance with claim 11 wherein said bars are interconnected at distal ends thereof by a third bar.

13. The method in accordance with claim 10 wherein said bodies are tubular members.

14. The method in accordance with claim 13 wherein a heating coil is disposed in each of said tubular members.

15. The method in accordance with claim 14 including the further step of providing electrical current to each of said heating coils to heat said tubular members to remove ice therefrom.

16. The method in accordance with claim 9 wherein one of said bodies is a metal rod and a second of said bodies is a generally cylindrically-shaped metal mesh sleeve disposed generally concentrically around said rod and spaced therefrom, said sleeve having a gap therein in a wall thereof extending substantially throughout a length of said sleeve.

* * * * *